US012611030B2

(12) United States Patent
Chen et al.

(10) Patent No.: US 12,611,030 B2
(45) Date of Patent: Apr. 28, 2026

(54) SLIDE RAIL ASSEMBLY

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Shun-Ho Yang, Kaohsiung City (TW); Chih-Hsin Yeh, Kaohsiung City (TW); Sheng-Wei Wang, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 62 days.

(21) Appl. No.: 18/818,578

(22) Filed: Aug. 28, 2024

(65) Prior Publication Data

US 2025/0318641 A1 Oct. 16, 2025

(30) Foreign Application Priority Data

Apr. 12, 2024 (TW) ..... 113113969

(51) Int. Cl.
*A47B 88/493* (2017.01)
*A47B 88/423* (2017.01)

(52) U.S. Cl.
CPC .... *A47B 88/493* (2017.01); *A47B 2088/4235* (2017.01); *A47B 2210/0037* (2013.01)

(58) Field of Classification Search
CPC . A47B 88/0407; A47B 88/407; A47B 88/443; A47B 88/493; A47B 88/10; A47B 2088/0044; A47B 2088/4235; A47B 2210/0016; A47B 2210/0018; A47B 2210/0035; A47B 2210/0081
See application file for complete search history.

(56) References Cited

U.S. PATENT DOCUMENTS 6,820,954 B2 11/2004 Judge
6,851,773 B2 2/2005 Chen
(Continued)

FOREIGN PATENT DOCUMENTS

JP 6-1840 U 1/1994
JP 3123193 U 7/2006
(Continued)

*Primary Examiner* — Andrew Roersma
(74) *Attorney, Agent, or Firm* — Winston Hsu

(57) ABSTRACT

A slide rail assembly is provided and includes a first rail, a second rail, an aiding-slide device and an auxiliary member. The aiding-slide device is movably mounted between the first rail and the second rail. The auxiliary member is arranged on the first rail. When the second rail is detached from a channel of the first rail, a first predetermined feature of the aiding-slide device is engaged with a second predetermined feature on a resilient arm of the auxiliary member for retaining the aiding-slide device at a predetermined position. When the second rail is inserted into the channel of the first rail, the second rail abuts against the resilient arm by a working portion, such that the second predetermined feature of the resilient arm is disengaged from the first predetermined feature of the aiding-slide device.

14 Claims, 10 Drawing Sheets

(56) References Cited

U.S. PATENT DOCUMENTS

| | | | | |
|---|---|---|---|---|
| 7,648,214 | B2 * | 1/2010 | Chen | A47B 88/493 312/334.47 |
| 7,699,415 | B2 | 4/2010 | Tseng | |
| 7,740,328 | B2 * | 6/2010 | Huang | A47B 88/477 312/333 |
| 7,878,607 | B2 * | 2/2011 | Huang | A47B 88/487 312/334.46 |
| 7,946,666 | B2 * | 5/2011 | Huang | A47B 88/493 312/334.46 |
| 8,534,782 | B2 * | 9/2013 | Yu | F16C 29/04 312/334.46 |
| 8,752,917 | B1 * | 6/2014 | Chang | A47B 88/487 312/334.47 |
| 9,279,451 | B2 | 3/2016 | Judge | |
| 9,980,566 | B2 * | 5/2018 | Chen | F16C 43/04 |
| 10,912,382 | B2 * | 2/2021 | Chen | A47B 88/493 |
| 11,178,965 | B2 * | 11/2021 | Wu | A47B 88/423 |
| 12,226,014 | B2 * | 2/2025 | Chen | A47B 88/487 |
| 12,232,614 | B2 * | 2/2025 | Chen | A47B 88/57 |
| 12,324,515 | B2 * | 6/2025 | Chen | A47B 88/423 |
| 2006/0163983 | A1 | 7/2006 | Wu | |
| 2008/0150409 | A1 | 6/2008 | Huang | |
| 2024/0122342 | A1 * | 4/2024 | Chen | A47B 88/44 |
| 2025/0188987 | A1 * | 6/2025 | Chen | F16C 29/04 |

FOREIGN PATENT DOCUMENTS

| | | | |
|---|---|---|---|
| JP | 2014-46045 | A | 3/2014 |
| JP | 2014-142483 | A | 8/2014 |
| JP | 2018-183327 | A | 11/2018 |

* cited by examiner

SLIDE RAIL ASSEMBLY

BACKGROUND OF THE INVENTION

1. Field of the Invention

The present invention relates to a slide rail product, and more specifically, to a slide rail assembly which utilizes a rail to terminate an engagement of an aiding-slide device and another rail.

2. Description of the Prior Art

U.S. Pat. No. 6,820,954 B2 discloses a slide rail assembly including a first rail, a second rail, a rolling ball module and a controller. The first rail and the second rail are a middle rail and an inner rail, respectively. The first rail includes a channel configured to receive the second rail and the rolling ball module. The rolling ball module is movably mounted between the first rail and the second rail and for facilitating a smooth displacement of the second rail relative to the first rail. The controller is disposed on the first rail and includes a lock. The lock includes a locking portion configured to stretch into the channel of the first rail through a hole on a lateral wall of the first rail for locking the rolling ball module at a predetermined position. When the second rail is inserted into the channel of the first rail, a protruding portion of the second rail abuts against the locking portion to disengage the locking portion from the rolling ball module for allowing the rolling ball module to displace from the predetermined position. However, the hole on the lateral wall of the first rail negatively affects a structural strength of the first rail.

Besides, U.S. Pat. No. 9,279,451 B2 discloses a slide rail assembly including an outer rail, a middle rail, an inner rail and a rolling ball module. The middle rail is movably mounted between the outer rail and the inner rail. The middle rail includes a channel configured to receive the inner rail. The rolling ball module is movably mounted between the middle rail and the inner rail. A locking arm is arranged on the middle rail and configured to engage with the rolling ball module, e.g., a ball retainer of the rolling ball module. The locking arm includes an engaging portion and an actuating portion. The actuating portion is configured to stretch into the channel of the middle rail through a hole on a lateral wall of the middle rail. The engaging portion is configured to engage with the rolling ball module for retaining the rolling ball module at a predetermined position. The actuating portion includes a bending part for cooperating with the inner rail to disengage the engaging portion from the rolling ball module. However, similarly, the hole on the lateral wall of the middle rail negatively affects a structural strength of the middle rail.

Furthermore, in U.S. Pat. No. 6,820,954 B2, the lock is configured to disengage from the rolling ball module by pushing the locking portion stretching into the channel of the first rail, and in U.S. Pat. No. 9,279,451 B2, the locking arm is configured to disengage from the rolling ball module by pushing the actuating portion stretching into the channel of the middle rail. However, the locking portion of U.S. Pat. No. 6,820,954 B2 and the actuating portion of U.S. Pat. No. 9,279,451 B2 may not only interfere with another structure, but also be pushed by another feature unintentionally due to stretching configurations. Therefore, U.S. Pat. No. 6,820,954 B2 and U.S. Pat. No. 9,279,451 B2 are deficient in supportability and displacement stability of the rails.

In addition, U.S. Pat. No. 6,851,773 B2 discloses an aiding-slide positioning mechanism for a drawer slide. The aiding-slide positioning mechanism includes a positioning member, an aiding-slide member and a releasing member. The positioning member is disposed on an opening end of a first rail and includes a resilient hook rod. The resilient hook rod includes a hook portion. The hook portion is configured to stretch into a hole on the first rail. The aiding-slide member is disposed between the first rail and a second rail and includes an engaging slot. The releasing member is fixed on the first rail and includes two inclined surfaces. When the second rail is detached from the first rail, the resilient hook rod of the positioning member can be engaged with the engaging slot of the aiding-slide member. When the second rail is inserted into the first rail, the inclined surface of the releasing member is configured to disengage the resilient hook rod of the positioning member from the engaging slot of the aiding-slide member. However, the hole on the first rail also negatively affects a structural strength of the first rail. Moreover, the resilient hook rod is configured to move upwardly and downwardly in a height direction of the first rail or the second rail.

Therefore, in order to meet various requirements, it becomes an important topic to provide an alternative solution for releasing an aiding-slide device to allow a displacement of the aiding-slide device.

SUMMARY OF THE INVENTION

It is an objective of the present invention to provide a slide rail assembly which utilizes a rail to terminate an engagement of an aiding-slide device and another rail.

According an aspect of the present invention, a slide rail assembly is provided and includes a first rail, a second rail, an aiding-slide device and an auxiliary member. The first rail includes a first wall, a second wall and a longitudinal wall connected between the first wall and the second wall of the first rail, and the first wall. The second wall and the longitudinal wall of the first rail cooperatively define a channel of the first rail. The second rail is movably mounted on the channel of the first rail. The aiding-slide device is movably mounted on the channel of the first rail. The aiding-slide device includes a main body and a plurality of rolling members arranged on the main body and supported between the first rail and the second rail. The main body of the aiding-slide device includes a first predetermined feature. The auxiliary member is arranged inside the channel of the first rail. The auxiliary member includes a resilient arm. A second predetermined feature and an actuating section are arranged on the resilient arm. The aiding-slide device is retained at a predetermined position by an engagement of the first predetermined feature and the second predetermined feature when the second rail is detached from the channel of the first rail along an opening direction. The second predetermined feature is driven to engage with first predetermined feature along a first transverse direction in response to a resilient force of the resilient arm. When the second rail is inserted into the channel of the first rail from outside of the channel of the first rail along a retracting direction, a working portion on the second rail abuts against the actuating section of the resilient arm to drive the resilient arm to disengage the second predetermined feature from the first predetermined feature along a second transverse direction for allowing the aiding-slide device to displace from the predetermined position along the retracting direction, and the first transverse direction is opposite to the second transverse direction.

According an aspect of the present invention, a slide rail assembly is provided and includes a first rail, a second rail, an aiding-slide device and an auxiliary member. The first rail includes a first wall, a second wall and a longitudinal wall connected between the first wall and the second wall of the first rail, and the first wall, the second wall and the longitudinal wall of the first rail cooperatively define a channel of the first rail. The second rail is movably mounted on the channel of the first rail. A working portion is arranged on the second rail. The aiding-slide device is movably mounted on the channel of the first rail. The aiding-slide device includes a main body and a plurality of rolling members arranged on the main body and supported between the first rail and the second rail. The main body of the aiding-slide device includes a first predetermined feature. The auxiliary member is arranged on the first rail. The auxiliary member includes a resilient arm. A second predetermined feature and an actuating section are arranged on the resilient arm, and the actuating section is spaced apart from the longitudinal wall of the first rail at a first transverse distance. The working portion is spaced apart from the longitudinal wall of the first rail at a second transverse distance less than the first transverse distance. The aiding-slide device is retained at a predetermined position by an engagement of the first predetermined feature and the second predetermined feature when the second rail is detached from the channel of the first rail along an opening direction. The second predetermined feature is driven to engage with first predetermined feature in response to a resilient force of the resilient arm. A guiding feature is formed on one of the working portion and the actuating section. When the second rail is inserted into the channel of the first rail from outside of the channel of the first rail along a retracting direction, the guiding feature abuts against another one of the working portion and the actuating section to drive the resilient arm to disengage the second predetermined feature from the first predetermined feature for allowing the aiding-slide device to displace from the predetermined position along the retracting direction.

In summary, the present invention can solve the aforementioned drawbacks in the prior art and has an enhanced structural strength.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
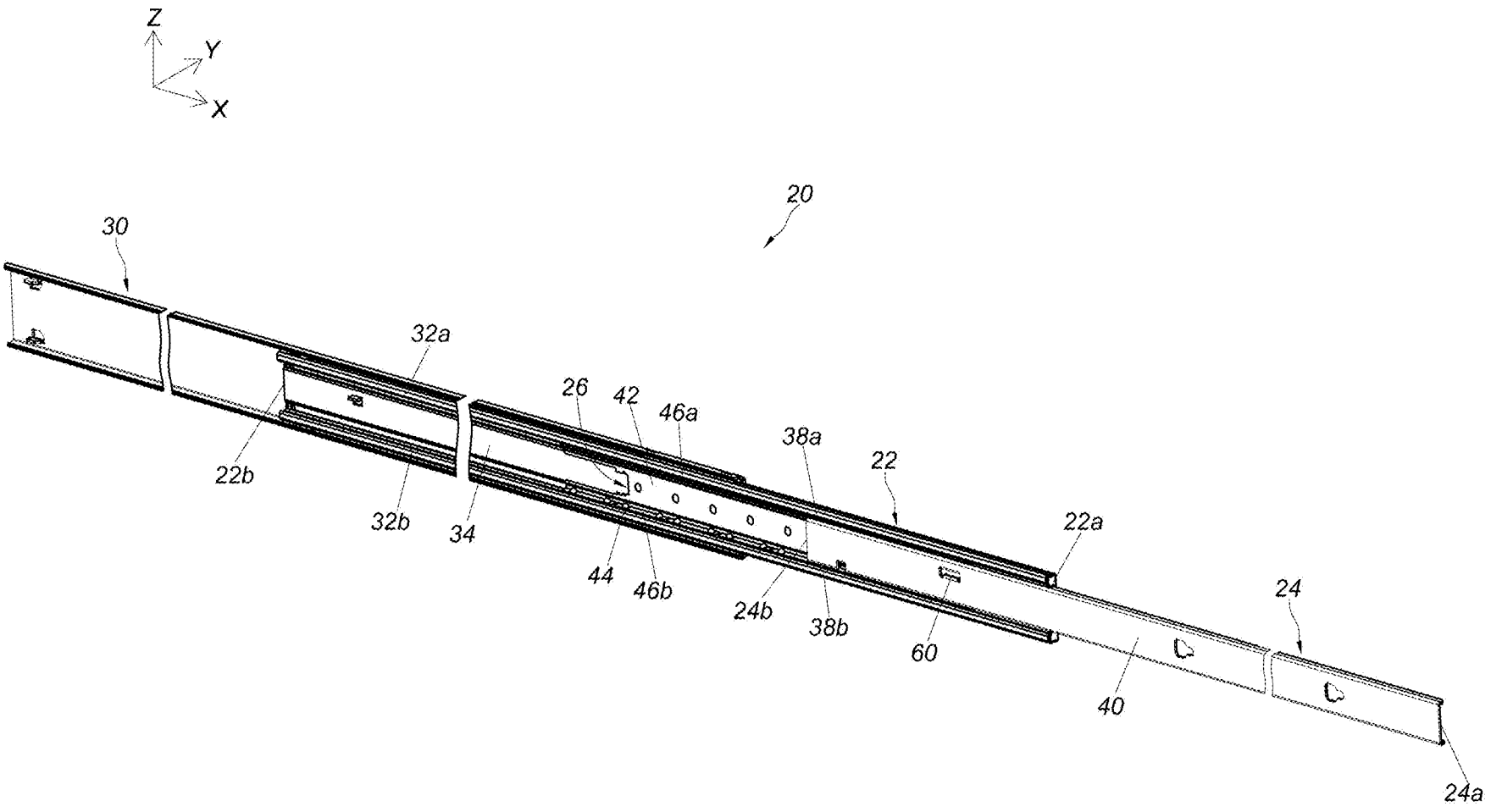
FIG. 1 is a schematic diagram of a slide rail assembly according to an embodiment of the present invention.
Figure 2:
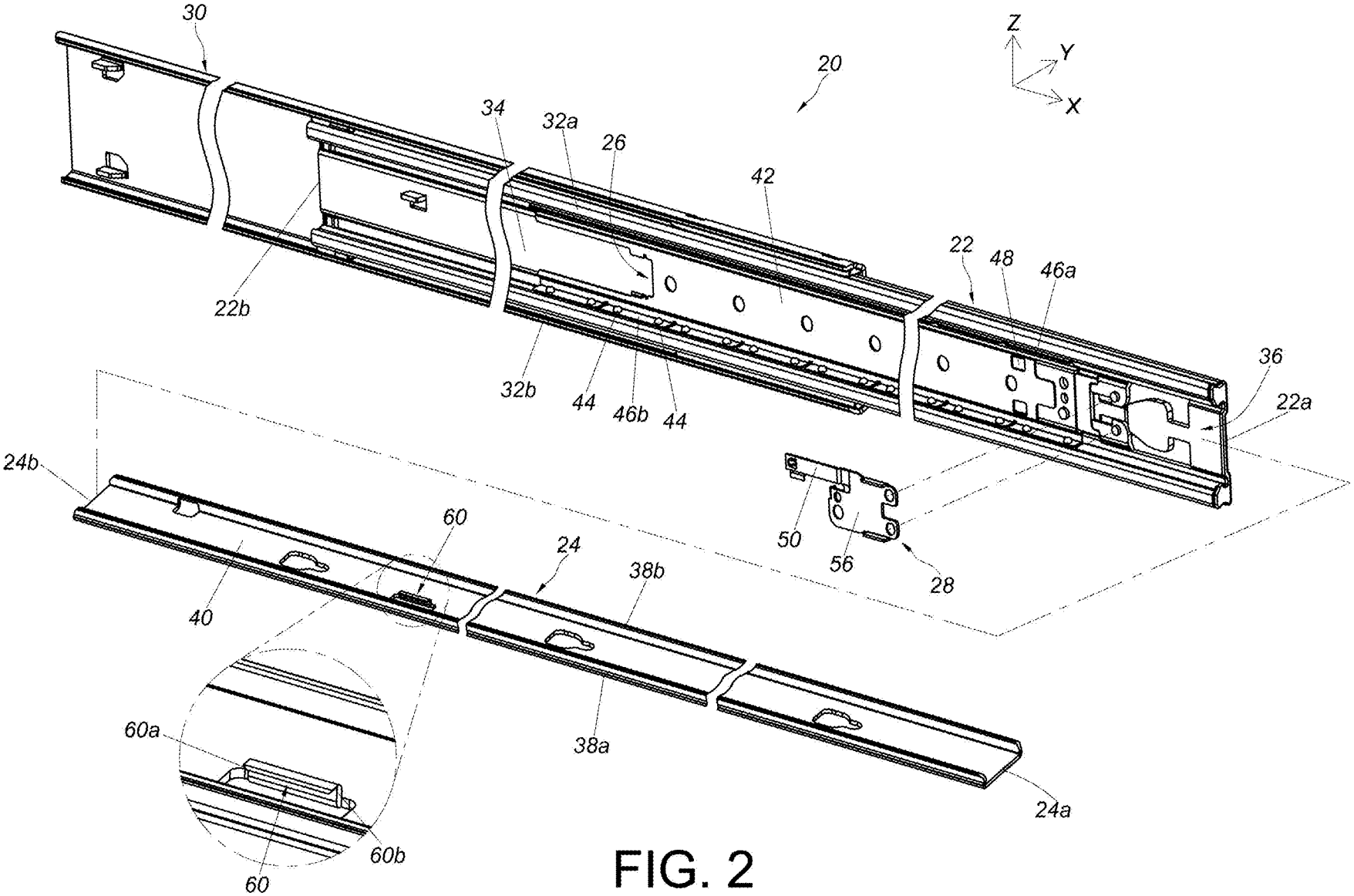
FIG. 2 is an exploded diagram of the slide rail assembly according to the embodiment of the present invention.

As shown in FIG. 1 and FIG. 2, a slide rail assembly 20 includes a first rail 22, a second rail 24, an aiding-slide device 26 and an auxiliary member 28. Preferably, the slide rail assembly 20 can further include a third rail 30, and the first rail 22 can be movably mounted between the second rail 24 and the third rail 30, i.e., the first rail 22, the second rail 24 and the third rail 30 can be a middle rail, an inner rail and an outer rail, respectively. In this embodiment, by way of example, a longitudinal direction can be defined by a length direction or a displacement direction of a slide rail, e.g., the first rail 22, the second rail 24, or the third rail 30, and parallel to an X axis. A transverse direction can be defined by a lateral direction or a width direction of the slide rail, e.g., the first rail 22, the second rail 24, or the third rail 30, and parallel to a Y axis. A vertical direction can be defined by a height direction of the slide rail, e.g., the first rail 22, the second rail 24, or the third rail 30, and parallel to a Z axis.

The first rail 22 includes a first wall 32*a*, a second wall 32*b* and a longitudinal wall 34 connected between the first wall 32*a* and the second wall 32*b* of the first rail 22. The first wall 32*a*, the second wall 32*b* and the longitudinal wall 34 of the first rail 22 cooperatively define a channel 36 of the first rail 22. The first rail 22 has a front end 22*a* and a rear end 22*b*.

The second rail 24 is movably mounted on the channel 36 of the first rail 22. The second rail 24 includes a first wall 38*a*, a second wall 38*b* and a longitudinal wall 40 connected between the first wall 38*a* and the second wall 38*b* of the second rail 24. The second rail 24 has a front end 24*a* and a rear end 24*b*.

The aiding-slide device 26 is movably mounted on the channel 36 of the first rail 22 and for facilitating a smooth displacement of the second rail 24 relative to the first rail 22. Specifically, the aiding-slide device 26 includes a main body 42 and a plurality of rolling members 44 arranged on the main body 42 and supported between the first rail 22 and the second rail 24. In this embodiment, by way of example, the plurality of rolling members 44 can be a plurality of rolling balls.

Preferably, the main body 42 of the aiding-slide device 26 includes a first edge portion 46*a* and a second edge portion 46*b*. The first edge portion 46*a* and the second edge portion 46*b* can have substantially identical structures. Furthermore, the plurality of rolling members 44 are longitudinally arranged on the first edge portion 46*a* and the second edge portion 46*b* at intervals, and the plurality of rolling members 44 are supported between the first wall 32*a* of the first rail 22 and the first wall 38*a* of the second rail 24 and between the second wall 32*b* of the first rail 22 and the second wall 38*b* of the second rail 24.

The auxiliary member 28 is arranged inside the channel 36 of the first rail 22. Preferably, the auxiliary member 28 is arranged on the longitudinal wall 34 of the first rail 22 and located adjacent to the front end 22*a* of the first rail 22.

Figure 3:
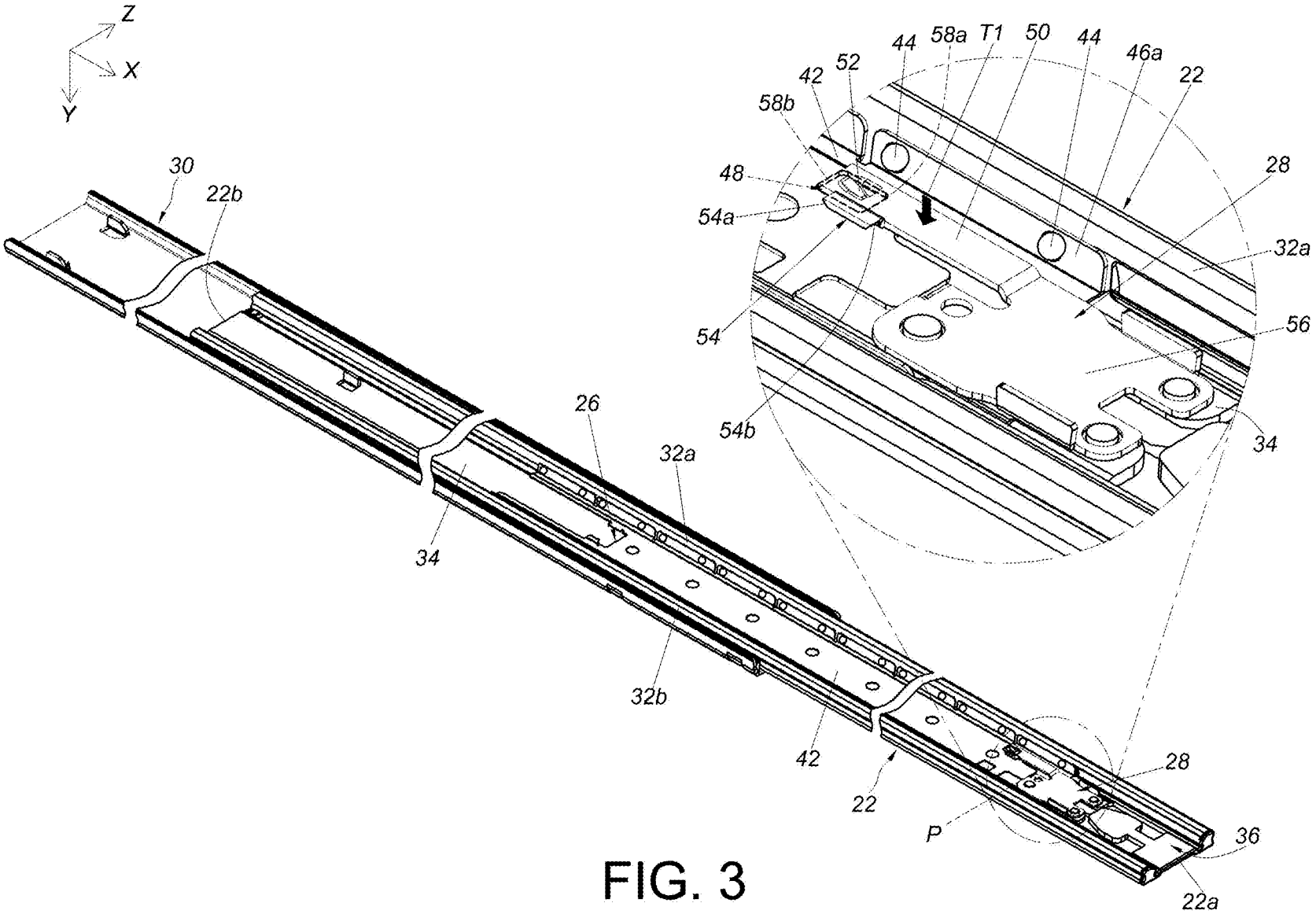
FIG. 3 is a partial diagram of the slide rail assembly as an aiding-slide device is retained at a predetermined position according to the embodiment of the present invention.
Figure 4:
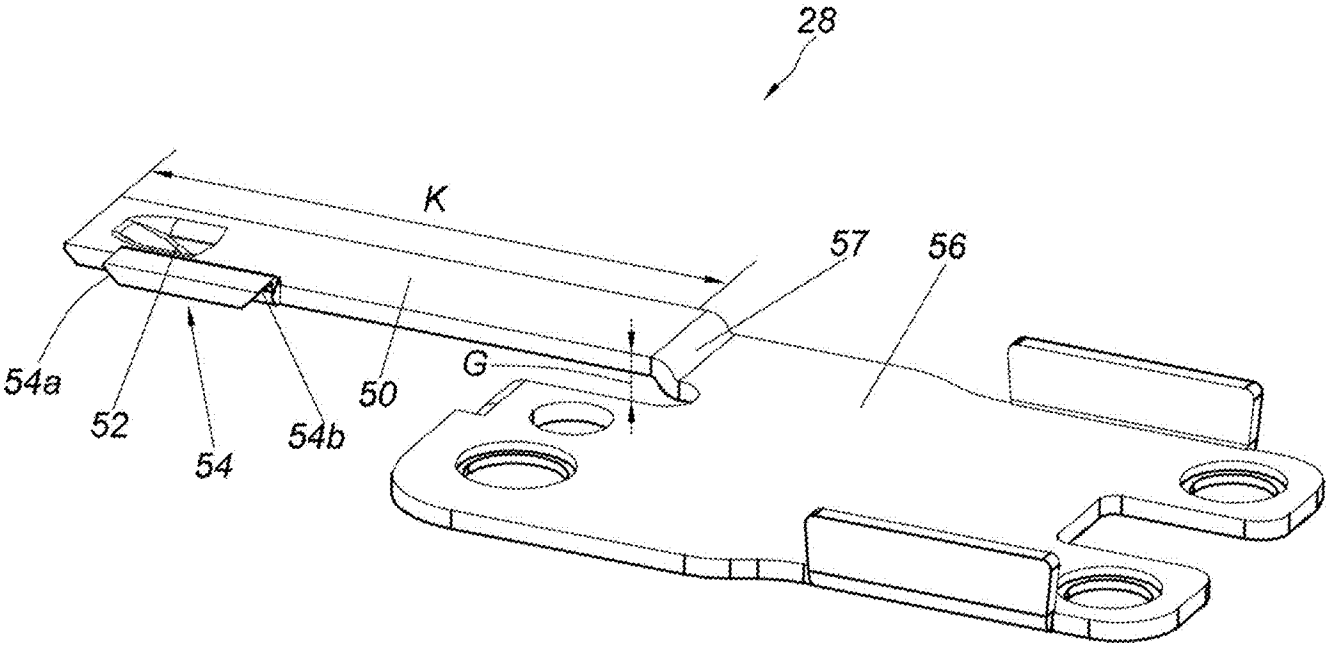
FIG. 4 is a diagram of an auxiliary member according to the embodiment of the present invention.

As shown in FIG. 3 and FIG. 4, the main body 42 of the aiding-slide device 26 includes a first predetermined feature 48. Furthermore, the auxiliary member 28 includes a resilient arm 50, and a second predetermined feature 52 and an actuating section 54 are arranged on the resilient arm 50. The second predetermined feature 52 is configured to cooperate with the first predetermined feature 48.

Preferably, the auxiliary member 28 further includes a connecting portion 56 fixed on the longitudinal wall 34 of the first rail 22. The resilient arm 50 extends from the connecting portion 56 in a direction towards the rear end 22*b* of the first rail 22. The resilient arm 50 includes two ends. One end of the resilient arm 50 is arranged with a bending portion 57 connected to the connecting portion 56, such that a transverse distance between another end of the resilient arm 50 away from the connecting portion 56 and the longitudinal wall 34 of the first rail 22 is greater than a transverse distance between the connecting portion 56 and the longitudinal wall 34 of the first rail 22 by a transverse difference G. The resilient arm 50 extends from the connecting portion 56 for a predetermined longitudinal distance K. The resilient arm 50 is located adjacent to the first wall 32*a* of the first rail 22. The actuating section 54 is connected to the resilient arm 50 and located adjacent to the second predetermined feature 52.

Preferably, the actuating section 54 includes a first end and a second end opposite to each other. A first guiding feature 54*a* is formed on the first end of the actuating section 54, and a second guiding feature 54*b* is formed on the second end of the actuating section 54. In this embodiment, by way of example, the first end and the second end of the actuating section 54 can be a rear end and a front end of the actuating section 54, respectively, and the first guiding feature 54*a* and the second guiding feature 54*b* can be inclined surfaces or arc surfaces.

Preferably, one of the first predetermined feature 48 and the second predetermined feature 52 is an accommodating structure defined by a plurality of walls, e.g., a front wall 58*a* and a rear wall 58*b*, and the other one of the first predetermined feature 48 and the second predetermined feature 52 is a protrusion configured to stretch into the accommodating structure. In this embodiment, by way of example, the first predetermined feature 48 can be the accommodating structure, e.g., a hole or a slot, and the second predetermined feature 52 can be the protrusion configured to stretch into the accommodating structure for engaging with the front wall 58*a* and the rear wall 58*b*.

Figure 5:
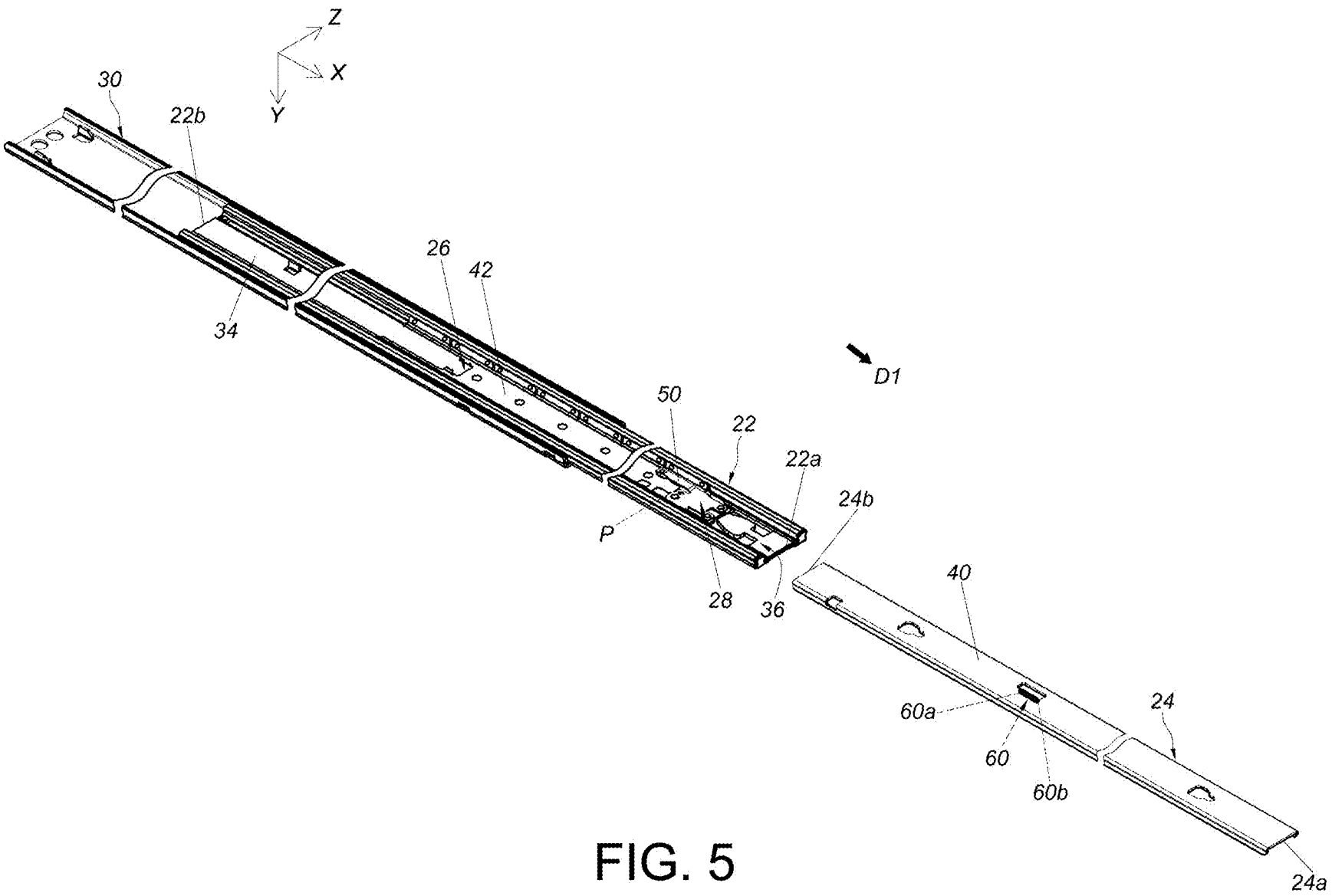
FIG. 5 is a diagram of the slide rail assembly as a second rail is detached from the channel of the first rail according to the embodiment of the present invention.

As shown in FIG. 5, when the second rail 24 is detached from the channel 36 of the first rail 22 along an opening direction D1, the aiding-slide device 26 can be retained at a predetermined position P by an engagement of the first predetermined feature 48 and the second predetermined feature 52. As shown in FIG. 3, the second predetermined feature 52 is configured to engage with the first predetermined feature 48 along a first transverse direction T1 in response to a resilient force of the resilient arm 50 along the first transverse direction T1. Preferably, when the aiding-slide device 26 is located at the predetermined position P, the aiding-slide device 26 is located adjacent to the front end 22*a* of the first rail 22.

Figure 6:
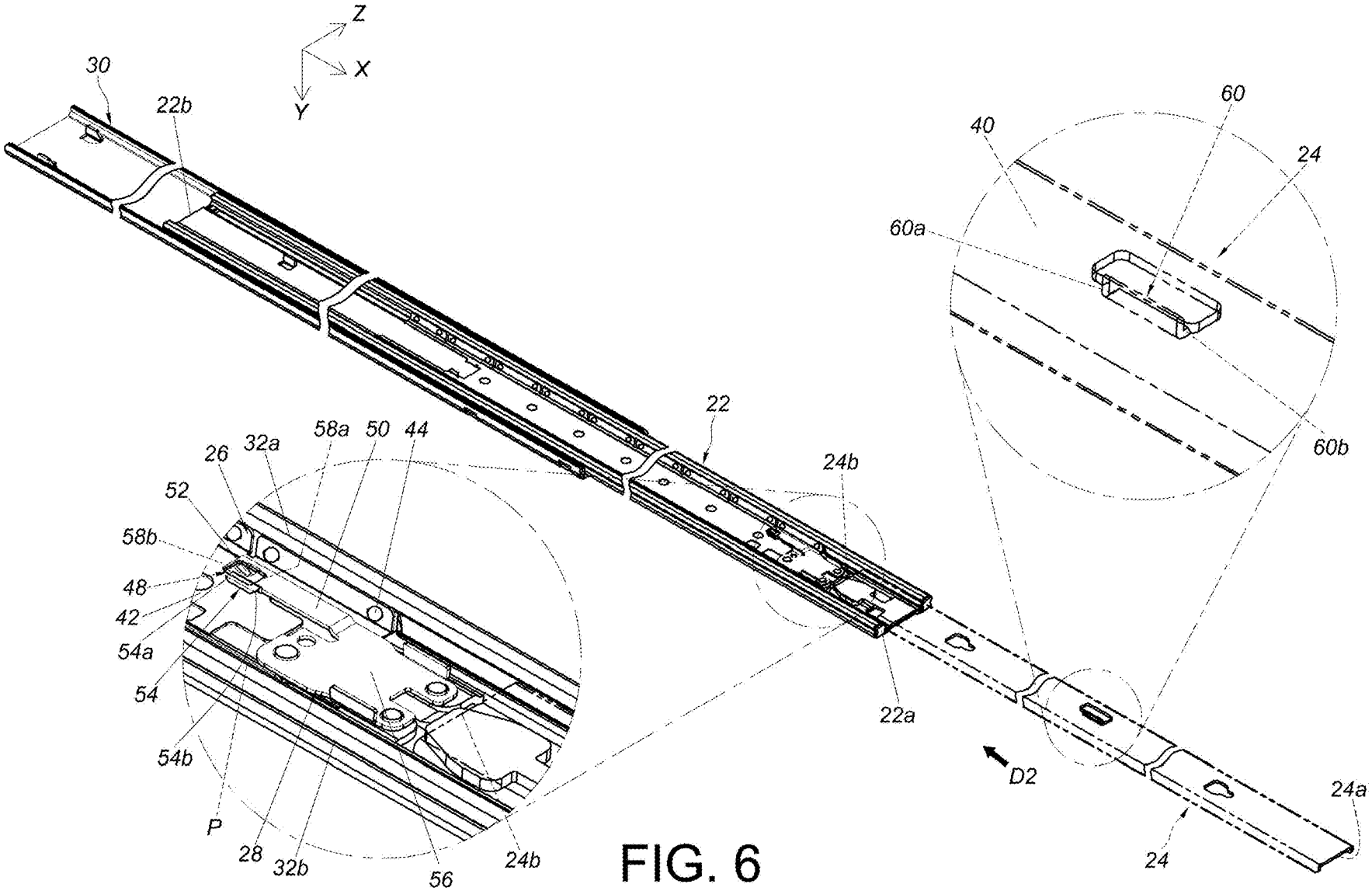
FIG. 6 is a diagram of the slide rail assembly as the second rail is inserted into the channel of the first rail according to the embodiment of the present invention.
Figure 7:
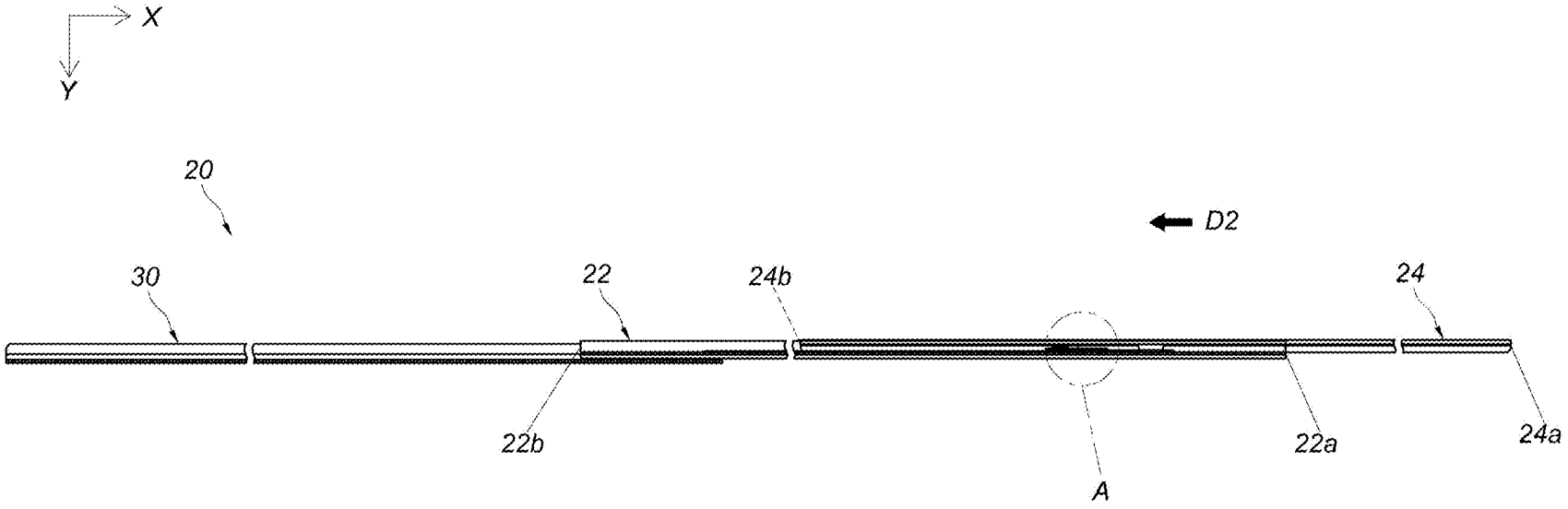
FIG. 7 is a diagram of the slide rail assembly at another view as the second rail is inserted into the channel of the first rail according to the embodiment of the present invention.
Figure 8:
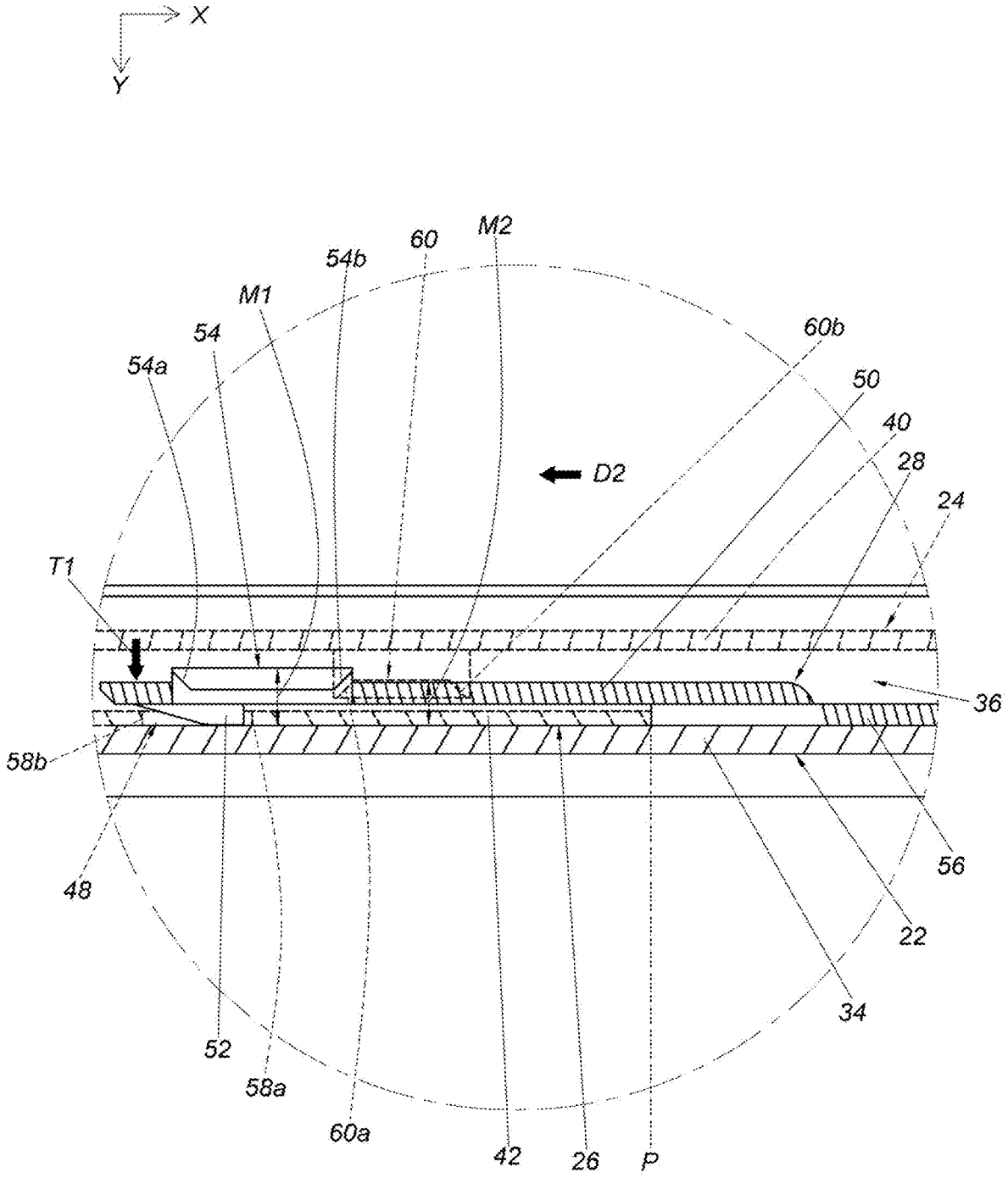
FIG. 8 is an enlarged diagram of an A portion of the slide rail assembly shown in FIG. 7 according to the embodiment of the present invention.

As shown in FIG. 6 to FIG. 8, a working portion 60 is arranged on the second rail 24. The working portion 60 can be directly formed on or indirectly connected to the second rail 24. In this embodiment, by way of example, the working portion 60 can extend from the longitudinal wall 40 of the second rail 24 in a bending manner. However, the present invention is not limited to this embodiment. The second rail 24 can be inserted into the channel 36 of the first rail 22 from outside of the channel 36 of the first rail 22 along a retracting direction D2, so as to be mounted on the channel 36 of the first rail 22. Preferably, the working portion 60 includes a first end and a second end, and a first guiding feature 60*a* and a second guiding feature 60*b* are formed on the first end and the second end of the working portion 60, respectively. In this embodiment, by way of example, the first end and the second end of the working portion 60 can be a rear end and a front end of the working portion 60, respectively, and the first guiding feature 60*a* and the second guiding feature 60*b* can be inclined surfaces or arc surfaces.

Besides, as shown in FIG. 8, the actuating section 54 of the resilient arm 50 is spaced apart from the longitudinal wall 34 of the first rail 22 at a first transverse distance M1, and the working portion 60 on the second rail 24 is spaced apart from the longitudinal wall 34 of the first rail 22 at a second transverse distance M2 less than the first transverse distance M1.

Figure 9:
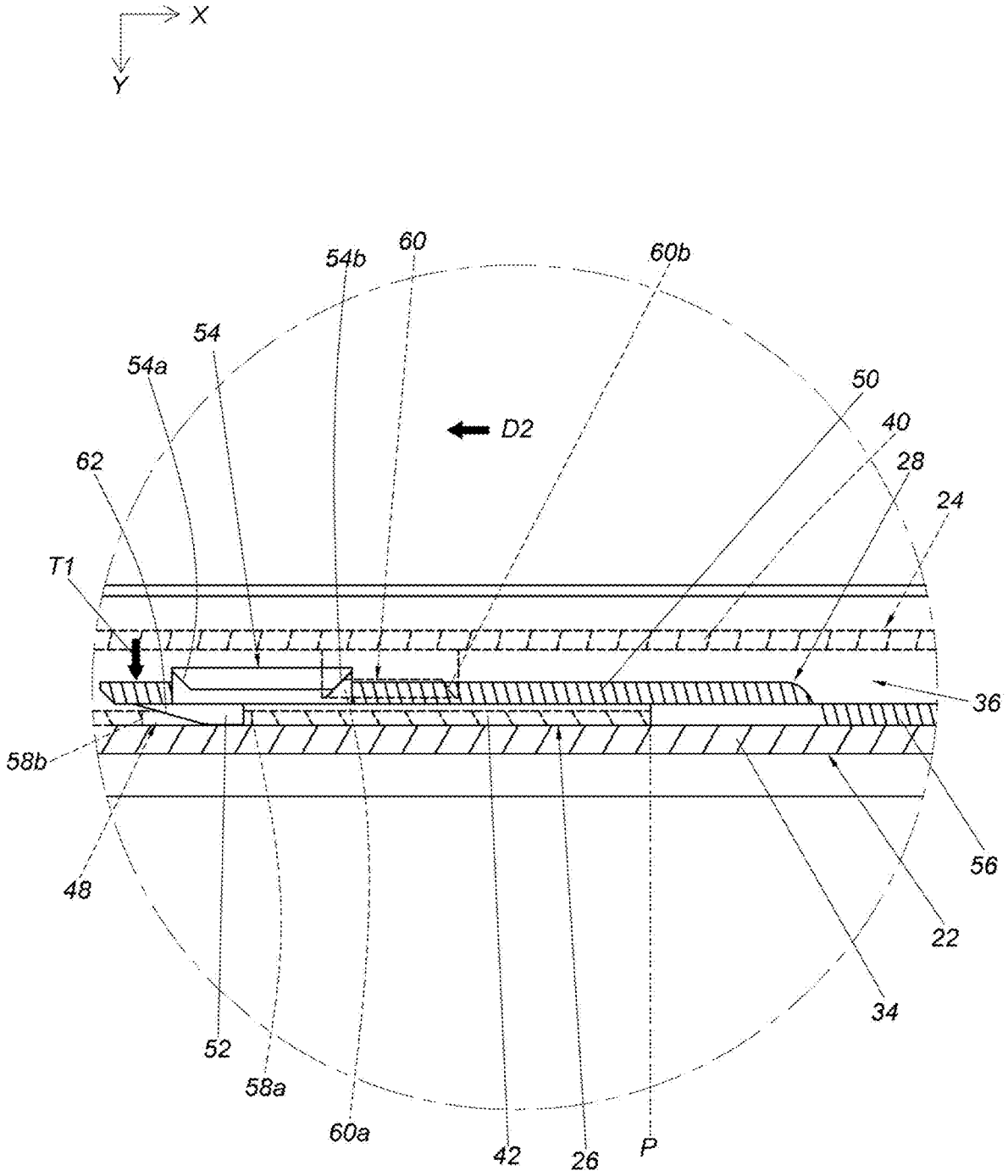
FIG. 9 is a partial enlarged diagram of the slide rail assembly as the second rail displaces from a position as shown in FIG. 8 along a retracting direction according to the embodiment of the present invention.
Figure 10:
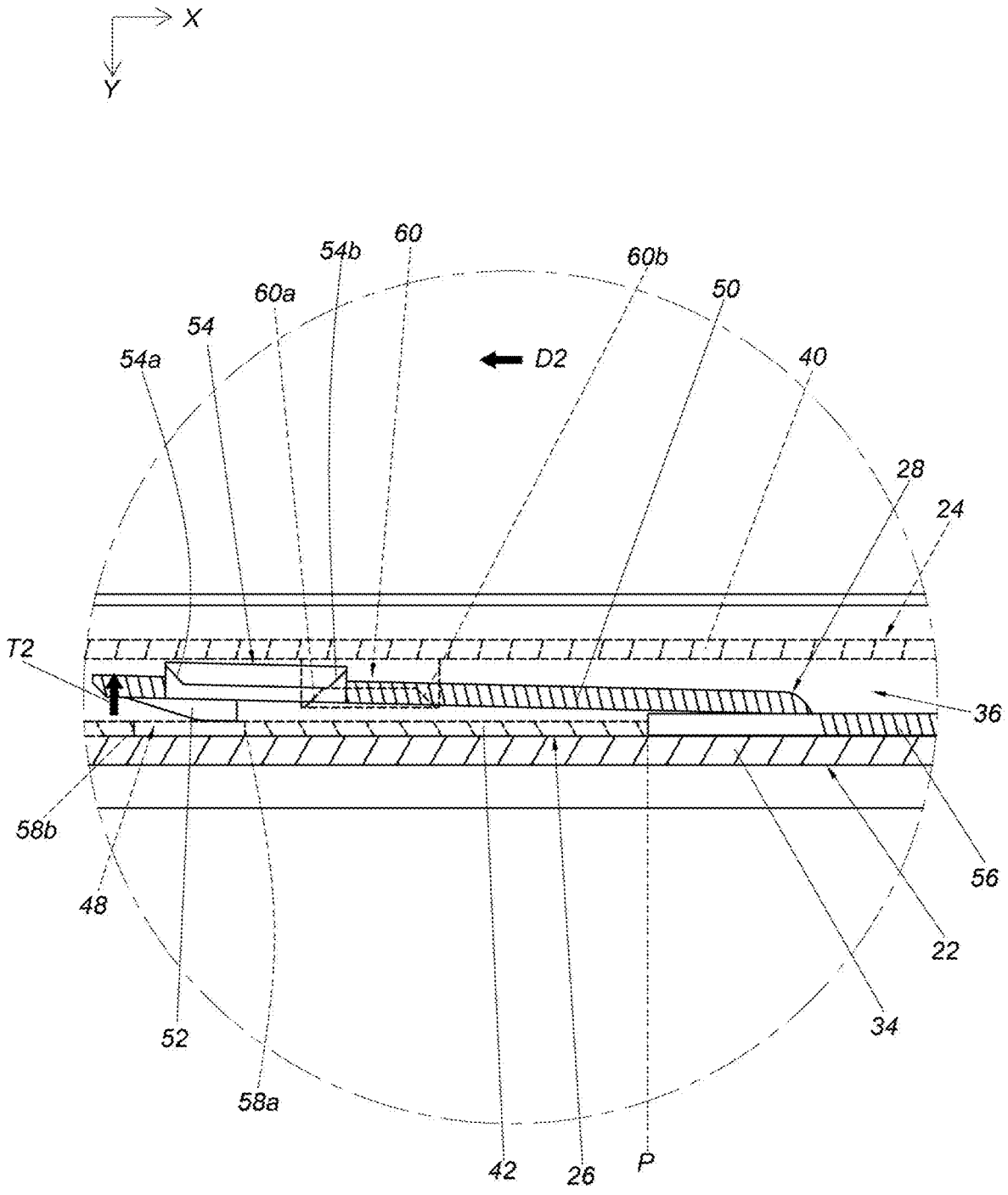
FIG. 10 is a partial enlarged diagram of the slide rail assembly as the second rail displaces from a position as shown in FIG. 9 along the retracting direction according to the embodiment of the present invention.

As shown in FIG. 9 and FIG. 10, when the second rail 24 is inserted into the channel 36 of the first rail 22 along the retracting direction D2, the first guiding feature 60*a* of the working portion 60 on the second rail 24 abuts against the second guiding feature 54*b* of the actuating section 54 of the resilient arm 50 to drive the resilient arm 50 to disengage the second predetermined feature 52 from the front wall 58*a* of the first predetermined feature 48 along a second transverse direction T2 opposite to the first transverse direction T1, so as to allow the aiding-slide device 26 to displace from the predetermined position P along the retracting direction D2. In such a way, when the second rail 24 further displaces from a position as shown in FIG. 10 along the retracting direction D2, the aiding-slide device 26 can displace along the retracting direction D2, so as to support the second rail 24 and ensure the second rail 24 to displace relative to the first rail 22 smoothly for facilitating a retracting displacement of the second rail 24 into the channel 36 of the first rail 22 along the retracting direction D2.

Preferably, as shown in FIG. 9, the first transverse direction T1 is in a direction toward the longitudinal wall 34 of the first rail 22, i.e., an engaging direction of the second predetermined feature 52 and the resilient force of the resilient arm 50 are in a direction toward the longitudinal wall 34 of the first rail 22, and as shown in FIG. 10, the second transverse direction T2 is in a direction away from the longitudinal wall 34 of the first rail 22, i.e., the second transverse direction T2 is in a direction toward the longitudinal wall 40 of the second rail 24.

Preferably, when the second predetermined feature 52 engages with the first predetermined feature 48 along the first transverse direction T1 in response to the resilient force of the resilient arm 50 along the first transverse direction T1, the second predetermined feature 52 abuts against the longitudinal wall 34 of the first rail 22, which enhances stability and reliability of the engagement of the first predetermined feature 48 and the second predetermined feature 52.

Preferably, the second predetermined feature 52 includes a guiding portion 62, e.g., an inclined surface or an arc surface. The guiding portion 62 is configured to facilitate a front end of the main body 42 of the aiding-slide device 26 to pass over the second predetermined feature 52 along the opening direction D1 until the second predetermined feature 52 engages with the first predetermined feature 48 to retain the aiding-slide device 26 at the predetermined position P as shown in FIG. 9.

From the above, the slide rail assembly 20 of the present invention has following characteristics.

1. Comparing to U.S. Pat. No. 6,820,954 B2, U.S. Pat. No. 9,279,451 B2 and U.S. Pat. No. 6,851,773 B2, the resilient arm 50 of the auxiliary member 28 of the present invention is configured to be arranged on the channel 36 of the first rail 22 to directly cooperate with the working portion 60 on the second rail 24. Therefore, the present invention does not require any hole or slot structure on the first rail 22, thereby enhancing the structural strength of the first rail 22.

2. Comparing to U.S. Pat. No. 9,279,451 B2, the second predetermined feature 52 and the actuating section 54 of the present invention are configured to move toward the longitudinal wall 40 of the second rail 24 only when the working portion 60 on the second rail 24 abuts against the actuating section 54 of the resilient arm 50 during insertion of the second rail 24 into the channel 36 of the first rail 22. In other words, the actuating section 54 does not occupy any moving space of any other part on the second rail 24 permanently. Therefore, the present invention can not only prevent the actuating section 54 from interfering with another structure on the second rail 24 but also ensure no unintentional disengagement of the second predetermined feature 52 and the first predetermined feature 48 due to accidental contact of the actuating section 54 and another structure or feature on the second rail 24 during a process that the second rail 24 is inserted into the channel 36 of the first 22 from outside of the channel 36 of the first rail 22 along the retracting direction D2, such that the aiding-slide device 26 will not be released from the predetermined position P before the first guiding feature 60*a* of the working portion 60 on the second rail 24 abuts against the second guiding feature 54*b* of the actuating section 54 of the resilient arm 50.

3. When the second predetermined feature 52 engages with the first predetermined feature 48 along the first transverse direction T1 in response to the resilient force of the resilient arm 50, the second predetermined feature 52 abuts against the longitudinal wall 34 of the first rail 22. Therefore, the present invention can provide enhanced stability and reliability of the engagement of the first predetermined feature 48 and the second predetermined feature 52.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly comprising:

a first rail comprising a first wall, a second wall and a longitudinal wall connected between the first wall and the second wall of the first rail, and the first wall, the second wall and the longitudinal wall of the first rail cooperatively defining a channel of the first rail;

a second rail movably mounted on the channel of the first rail, and the second rail comprising a first wall, a second wall and a longitudinal wall connected between the first wall and the second wall of the second rail;

an aiding-slide device movably mounted on the channel of the first rail, the aiding-slide device comprising a main body and a plurality of rolling members arranged on the main body and supported between the first rail and the second rail, the main body of the aiding-slide device comprising a first predetermined feature; and an auxiliary member arranged inside the channel of the first rail, the auxiliary member comprising a resilient arm, and a second predetermined feature and an actuating section being arranged on the resilient arm;

wherein the aiding-slide device is retained at a predetermined position by an engagement of the first predetermined feature and the second predetermined feature when the second rail is detached from the channel of the first rail along an opening direction;

wherein the second predetermined feature is driven to engage with the first predetermined feature along a first transverse direction in response to a resilient force of the resilient arm;

wherein when the second rail is inserted into the channel of the first rail from outside of the channel of the first rail along a retracting direction, a working portion on the second rail abuts against the actuating section of the resilient arm to drive the resilient arm to disengage the second predetermined feature from the first predetermined feature along a second transverse direction for allowing the aiding-slide device to displace from the predetermined position along the retracting direction, and the first transverse direction is opposite to the second transverse direction;

wherein the first transverse direction is in a direction toward the longitudinal wall of the first rail, and the second transverse direction is in a direction away from the longitudinal wall of the first rail and toward the longitudinal wall of the second rail.

2. The slide rail assembly of claim 1, wherein one of the first predetermined feature and the second predetermined feature is an accommodating structure defined by a plurality of walls, and another one of the first predetermined feature and the second predetermined feature is a protrusion configured to stretch into the accommodating structure.

3. The slide rail assembly of claim 1, wherein the auxiliary member further comprises a connecting portion fixed on the longitudinal wall of the first rail, and the resilient arm extends from the connecting portion for a predetermined longitudinal distance and is located adjacent to the first wall of the first rail.

4. The slide rail assembly of claim 3, wherein the resilient arm is arranged with a bending portion connected to the connecting portion, such that a transverse distance between the resilient arm and the longitudinal wall of the first rail is greater than a transverse distance between the connecting portion and the longitudinal wall of the first rail.

5. The slide rail assembly of claim 1, wherein the actuating section is connected to the resilient arm and located adjacent to the second predetermined feature.

6. The slide rail assembly of claim 1, wherein the main body of the aiding-slide device comprises a first edge portion and a second edge portion, the plurality of rolling members are arranged on the first edge portion and the second edge portion, and the plurality of rolling members are supported between the first wall of the first rail and the first wall of the second rail and between the second wall of the first rail and the second wall of the second rail.

7. A slide rail assembly comprising:

a first rail comprising a first wall, a second wall and a longitudinal wall connected between the first wall and the second wall of the first rail, and the first wall, the second wall and the longitudinal wall of the first rail cooperatively defining a channel of the first rail;

a second rail movably mounted on the channel of the first rail, a working portion being arranged on the second rail;

an aiding-slide device movably mounted on the channel of the first rail, the aiding-slide device comprising a main body and a plurality of rolling members arranged on the main body and supported between the first rail and the second rail, the main body of the aiding-slide device comprising a first predetermined feature; and an auxiliary member arranged on the first rail, the auxiliary member comprising a resilient arm, a second predetermined feature and an actuating section being arranged on the resilient arm;

wherein the aiding-slide device is retained at a predetermined position by an engagement of the first predetermined feature and the second predetermined feature when the second rail is detached from the channel of the first rail along an opening direction;

wherein the second predetermined feature is driven to engage with the first predetermined feature in response to a resilient force of the resilient arm;

wherein a guiding feature is formed on one of the working portion and the actuating section, when the second rail is inserted into the channel of the first rail from outside of the channel of the first rail along a retracting direction, the guiding feature abuts against another one of the working portion and the actuating section to drive the resilient arm to disengage the second predetermined feature from the first predetermined feature for allowing the aiding-slide device to displace from the predetermined position along the retracting direction;

wherein when the guiding feature abuts against the another one of the working portion and the actuating section, the working portion is at least partially located within a space between the actuating section and the longitudinal wall of the first rail.

8. The slide rail assembly of claim 7, further comprising a third rail, and the first rail being movably mounted between the third rail and the second rail.

9. The slide rail assembly of claim 7, wherein the resilient force of the resilient arm is in a direction toward the longitudinal wall of the first rail.

10. The slide rail assembly of claim 7, wherein one of the first predetermined feature and the second predetermined feature is a hole, and another one of the first predetermined feature and the second predetermined feature is a protrusion configured to stretch into the hole and engage with a wall of the hole.

11. The slide rail assembly of claim 7, wherein the auxiliary member further comprises a connecting portion fixed on the longitudinal wall of the first rail, and the resilient arm extends from the connecting portion for a predetermined longitudinal distance.

12. The slide rail assembly of claim 11, wherein the actuating section is connected to the resilient arm and located adjacent to the second predetermined feature.

13. The slide rail assembly of claim 7, wherein the second rail comprises a first wall, a second wall and a longitudinal wall connected between the first wall and the second wall of the second rail, the main body of the aiding-slide device comprises a first edge portion and a second edge portion, the plurality of rolling members are arranged on the first edge portion and the second edge portion, and the plurality of rolling members are supported between the first wall of the first rail and the first wall of the second rail and between the second wall of the first rail and the second wall of the second rail.

14. The slide rail assembly of claim 7, wherein the first rail comprises a front end and a rear end, and the aiding-slide device is located adjacent to the front end of the first rail when the aiding-slide device is located at the predetermined position.

* * * * *